US008550965B2

(12) United States Patent
Candela et al.

(10) Patent No.: US 8,550,965 B2
(45) Date of Patent: Oct. 8, 2013

(54) ABDOMINAL EXERCISE DEVICE

(76) Inventors: Elizabeth A Candela, Glen Ridge, NJ (US); Ronald J Hedenberg, Glen Ridge, NJ (US)

( * ) Notice: Subject to any disclaimer, the term of this patent is extended or adjusted under 35 U.S.C. 154(b) by 250 days.

(21) Appl. No.: 12/979,770

(22) Filed: Dec. 28, 2010

(65) Prior Publication Data

US 2011/0160024 A1 Jun. 30, 2011

Related U.S. Application Data

(60) Provisional application No. 61/290,697, filed on Dec. 29, 2009.

(51) Int. Cl.
*A63B 23/02* (2006.01)
*A63B 22/20* (2006.01)
*A63B 21/068* (2006.01)

(52) U.S. Cl.
USPC ..... 482/132; 482/95; 482/141; 601/120; 601/131

(58) Field of Classification Search
USPC ..... 482/51, 92, 95, 96, 131, 132, 140, 482/141, 146, 907, 908; 601/120, 129, 131; 273/449
See application file for complete search history.

(56) References Cited

U.S. PATENT DOCUMENTS 3,796,431 A * 3/1974 Sinyard ..... 482/132
4,973,046 A * 11/1990 Maxwell ..... 482/60
5,695,436 A * 12/1997 Huang ..... 482/121
5,713,823 A * 2/1998 Walendzak et al. ..... 482/142
6,013,010 A * 1/2000 Farsaie ..... 482/46
6,017,296 A * 1/2000 Tang et al. ..... 482/132
6,190,292 B1 * 2/2001 Panes ..... 482/93
6,254,518 B1 * 7/2001 Yu ..... 482/140
6,264,587 B1 * 7/2001 Lee ..... 482/132
6,338,703 B1 * 1/2002 Yu ..... 482/132
6,348,027 B1 * 2/2002 Lee ..... 482/132
6,354,983 B1 * 3/2002 Lee ..... 482/132
6,409,639 B1 * 6/2002 Kuo ..... 482/140
6,582,347 B2 6/2003 Smith ..... 482/140

(Continued)

FOREIGN PATENT DOCUMENTS

GB 2096005 A * 10/1982

OTHER PUBLICATIONS

Bird et al.; "*Electromyographic Comparisons of the Ab-Slice and Crunch Exercise*"; Journal of Strength and Conditioning Research 20(2); 2006; pp. 436-439.

(Continued)

*Primary Examiner* — Loan Thanh
*Assistant Examiner* — Victor K Hwang
(74) *Attorney, Agent, or Firm* — Ohlandt, Greeley, Ruggiero & Perle, LLP

(57) ABSTRACT

An exercise device that allows a user to strengthen the entire anatomical core muscles with a lightweight, compact, and portable design. A device includes a housing that is substantially spherical in shape with a hollow portion therein. The housing has at least one protrusion. A ball that is substantially spherical in shape is positioned within said hollow portion such that said housing at least partially encloses the ball therein. A plurality of bearings are disposed between said housing and said ball. The bearings contact the housing and the ball, thereby allowing said housing to rotate about said ball. A plurality of handles detachably connect to the at least one protrusion.

9 Claims, 7 Drawing Sheets

(56) References Cited

U.S. PATENT DOCUMENTS

| | | | | |
|---|---|---|---|---|
| 6,752,747 | B2 * | 6/2004 | Yu | 482/110 |
| 7,468,025 | B2 * | 12/2008 | Hauser et al. | 482/141 |
| 7,601,107 | B2 * | 10/2009 | Maloy et al. | 482/123 |
| 7,621,858 | B2 | 11/2009 | Sheron | 482/132 |
| 7,658,700 | B2 * | 2/2010 | Maloy et al. | 482/132 |
| 7,678,027 | B2 * | 3/2010 | Sanghavi | 482/76 |
| 7,993,250 | B2 * | 8/2011 | Abbott | 482/93 |
| 8,353,808 | B1 * | 1/2013 | Barney | 482/132 |
| 2001/0001094 | A1 | 5/2001 | Panes | 482/93 |
| 2005/0209072 | A1 | 9/2005 | Sheron | 482/132 |
| 2010/0261590 | A1 * | 10/2010 | Fares | 482/131 |

OTHER PUBLICATIONS

Sternlicht et al.; "*Electromyographical Analysis and Comparison of Selected Abdominal Training Devices with a Thousand Crunch*"; Journal of Strength and Conditioning Research 19(1); pp. 157-162, 2005.

Escamilla et al.; "*Electromyographic Analysis of Traditional and Nontraditional Abdominal Exercise: Implications for Rehabilitation and Training*"; Physical Therapy; 86(5); pp. 656-671, May 2006.

Marshall et al.; "*Changes in Muscile Activity and Perceived Exertion During Exercises Performed on a Swill Ball*"; Applied Physiology, Nutrition & Metabolism; 31(4); pp. 376-383, 2006.

* cited by examiner

ABDOMINAL EXERCISE DEVICE

This application claims the benefit of U.S. Provisional Application No. 61/290,697 filed on Dec. 29, 2009 is hereby incorporated by reference in its entirety.

BACKGROUND

1. Field of the Disclosure

The present disclosure relates to an exercise device. More specifically, the present disclosure relates to an exercise device for strengthening the abdominal and core muscles by providing a 360-degree range of motion, while incorporating balance during use.

2. Description of Related Art

Traditionally, abdominal exercises have been limited to conventional sit-ups and crunches. This involves a "starting position" where one lies down in a supine position with the knees bent in a 90° angle and feet flat on the floor, and then moving into the "up position" which involves curling the torso of the body upward toward the knees until a 30° angle is reached for a crunch and an angle greater than 45° for a traditional sit-up. Finally, one would return to the supine position. However, if done improperly, the sit-up can cause injury to the hip flexor muscles. Since the hip flexors help stabilize the lower back region, injury to the hip flexors could lead to further problems, including potential low back pain or lower back injuries. Additionally, if done by a person whose lower back muscles are unconditioned, the sit-up can cause injury to the lower lumbar region of the spine. Furthermore, conventional sit-ups and crunches mainly target the recruitment of the upper and lower rectus abdominis, but do not safely recruit the prime movers of the entire anatomical core (hereinafter reference to "the entire anatomical core" includes the hip joint extensors (gluteus maximus and hamstrings), hip flexors (iliopsas, pectineus and rectus femoris), lumbar and thoracic spine movers (rectus abdominus, transversus abdominis, internal and external obliques, erector spinae group and transverospinalis group) lateral flexors (quadratus lumborum, internal and external obliques and the upper and lower rectus abdominis), and as well as glenhumeral and scapular joint extensors, flexors, abductors, adductors and rotators) throughout a full range of concentric and eccentric muscle contractions.

In addition, a traditional sit-up will recruit the aid of the hip flexor muscles in lieu of the abdominal muscles, while stressing the hip flexor muscles. Furthermore, conventional sit-ups and crunches do not incorporate balance, benefiting the entire anatomical, while mimicking the same type of forces and muscle activity required for to develop power during sport specific activities, as well as developing and maintaining physiological fitness necessary for every day living.

Recently, a number of products have been developed to train the abdominal muscles to achieve trunk stability, aid in injury prevention and rehabilitation, reduce lower back and lumbar pathologies and improve athletic performance as well as general appearance.

These products range from the use of abdominal chairs, slides, rollers, coasters, exercise balls and tubing. However, all of these products contain limitations during use, particularly the abdominal resistance devices that use a bidirectional motion. In fact, numerous electromyographic (EMG) studies have been completed to determine whether these abdominal resistance apparatus are as effective, less effective or more effective than a traditional crunch.

For example, the AB WHEEL and POWER WHEEL are devices that have two wheels and two plastic handles. The user grabs the handles, leans forward and repeatedly rolls the device in a forward and backward motion. This provides resistance to the abdominal muscles, shoulders, arms and back. As with other variable resistance devices that require the user to exercise the abdominals in a kneeling position, the upper and lower rectus abdominis muscles are recruited at a similar level of intensity as the traditional crunch. However, because the user can only move in a bidirectional manner, the WHEEL-type resistance devices recruit the external obliques significantly less than the traditional crunch. Since the user moves in a bidirectional manner, the focus is on the rectus abdominis muscles, as opposed to the entire anatomical core, especially the internal and external obliques and the transversus abdominis muscles. In fact, recent research shows that while using the POWER WHEEL, EMG activity for the internal and external oblique muscles was not as high as the EMG activity recorded for the rectus abdominis muscles.

The AB ROLLER SLIDE is an abdominal resistance device having multiple wheels within a casing and two plastic handles that the user moves in a bidirectional manner, like the AB WHEEL. In addition, the AB ROLLER SLIDE uses a spring mechanism to generate tension that must be overcome during the concentric phase and controlled during the eccentric phase. Research has shown that the tension from the AB ROLLER SLIDE interferes with the recruitment of the upper and lower rectus abdominis and external oblique muscles during concentric activation. In addition, like the AB WHEEL, the AB ROLLER SLIDE targets the rectus abdominis without specific recruitment of the internal and external obliques or the transversus abdominis.

Furthermore, the AB WHEEL, POWER WHEEL and AB ROLLER SLIDE do not incorporate balance. Research has shown that abdominal exercises that incorporate an unstable support system promote a significant increase in abdominal co-activation during resistance exercises. Incorporating balance coactively recruits the abdominal muscles and trunk muscles resulting in total core training. Training the entire core helps to decrease risk of injury to the spine and lower back, while improving posture, balance and muscle coordination thereby increasing efficiency of movement. In addition, core training helps enhance the ability to transfer force from the legs to the upper body, which is important for agility during athletic performance and injury prevention.

The AB DOLLY PLUS® contains a flat board with ergonomic handles positioned along the edge of the board. The board is attached to four casters. Like the other products described, this device does not incorporate balance into its exercise. Although this product allows the user to move multidirectionally, the casters need time to adjust direction, thus producing multi-directional movement that is awkward when the user attempts to change directions.

Similarly, the abdominal platform described in U.S. Pat. No. 5,582,347 (hereinafter "the '347 patent") exemplifies another sliding device limited to bi-directional movement. Specifically, the abdominal slider described within the '347 patent provides for a platform that slides along a plane analogous to a mechanics dolly.

Other attempts to provide abdominal exercising described in U.S. Pat. No. 7,621,858 (hereinafter "the '858 patent"), overly complicate abdominal training. In particular, the '858 patent describes a rolling unit strapped to each hand.

Therefore, a need exits for an exercise device that allows the user to effectively target the outer core muscles (upper and lower abdominis rectus, internal oblique and external oblique muscles) while activating the inner core muscles (transverses abdominus, the diaphragm, the pelvic floor and the lumbar multifidus), thereby benefiting the body's total core via a single device. In particular, there is a need for a device that allows the user to move in a multidirectional manner while incorporating balance into the exercise in order to provide coordination while strengthening the entire core.

Additional objects, advantages and novel features of the present disclosure will be set forth in part in the description which follows, and in part will become apparent to those skilled in the art upon examination of the following or may be learned by practice of the present disclosure. The objects and advantages of the present disclosure may be realized and attained by means of the instrumentalities and combinations particularly pointed out in the appended claims.

SUMMARY

An exercise device that allows a user to strengthen the entire anatomical core with a single, lightweight, compact, portable device.

A device that includes a housing that is substantially spherical in shape with a hollow portion therein. The housing has at least one protrusion. A ball that is substantially spherical in shape is positioned within the hollow portion such that the housing partially encloses the ball therein. A plurality of bearings are disposed between the housing and the ball. The plurality of bearings contact the housing and the ball thereby allowing the ball to rotate about the housing. A plurality of handles detachably connect to the at least one protrusion of the housing.

The housing of the device is configured to confine the plurality of bearings such that the plurality of bearings maintain contact with the housing and the ball. Confining the plurality of bearings can be accomplished with an inner collar.

An exercise device having a ball, a housing compartment and removable handles attached to the housing compartment. The housing compartment envelops the ball to prevent it from falling out and contains a ball bearing system for smooth, fluid 360 degree range of movement.

An exercise device having handles that can be removed and replaced with various styles of handles allowing the user to alter positions and target various abdominal and core muscles.

The above-described and other features and advantages of the present disclosure will be appreciated and understood by those skilled in the art from the following detailed description, drawings, and appended claims.

DETAILED DESCRIPTION OF THE DISCLOSURE

Figure 1:
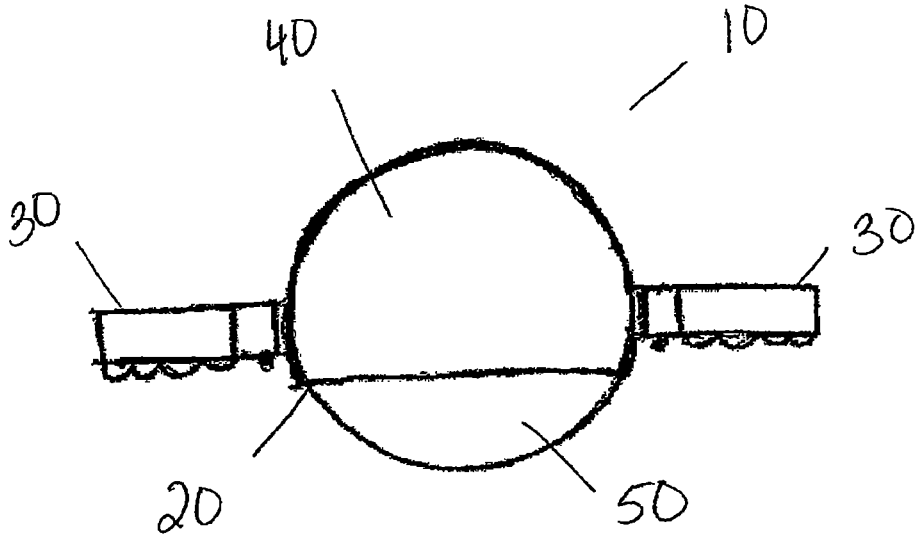
FIG. 1 is a front view of an exercise device of the present disclosure.

Referring to the drawings, an exercise device according to the present disclosure is shown and generally referenced to by numeral 10. Exercise device 10 allows a user to exercise the abdominal muscles and core muscles with a single device that can be easily adapted into any core training routine. FIG. 1 shows one embodiment of exercise device 10 having a base 20 that includes housing, or outer shell 40 and a ball 50. Base 20 has a removable handle 30 on each side that can be attached to housing 40.

Ball 50 is hollow and solid in structure. Ball 50 is able to support the body weight of a user of exercise device 10. Preferably, ball 50 is hollow to provide exercise device 10 with a lightweight feel and ease when transporting. Ball 50 is made from a resilient material such as high strength plastic, rubber, vinyl or other similar material. Preferably, ball 50 is a smooth sphere shaped structure allowing exercise device 10 to be used in a fluid motion. Ball 50 typically has a diameter ranging from about six (6) to ten (10) inches. Preferably, ball 50 has a diameter of about seven (7) inches.

Figure 2:
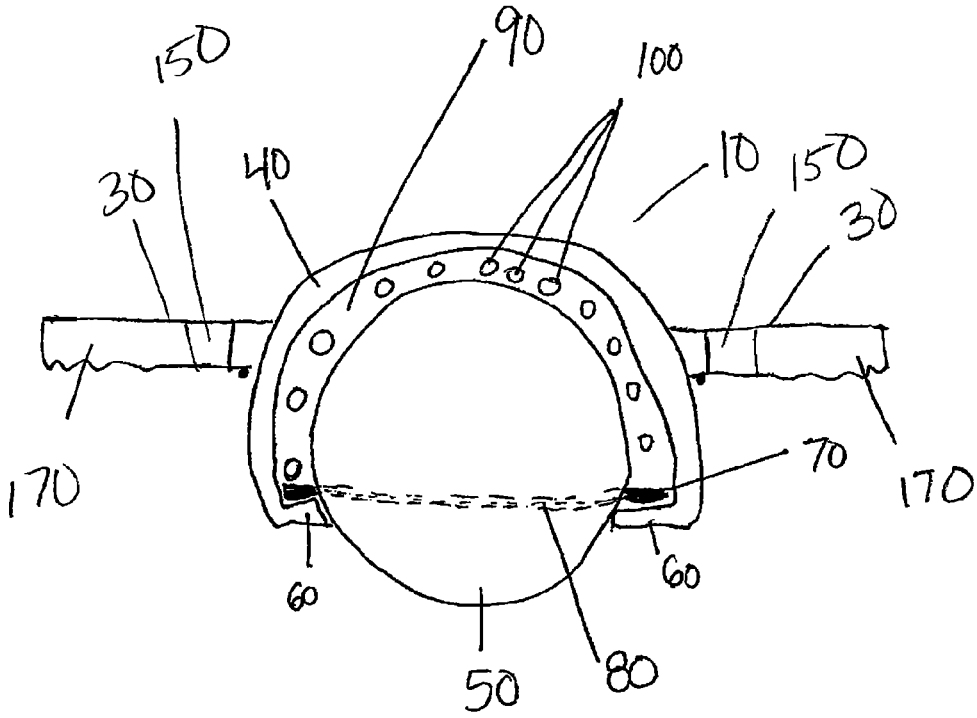
FIG. 2 is a cross sectional view of the exercise device of FIG. 1.

As shown in FIG. 1 ball 50 is encased within housing 40. Housing 40 has a semi-spherical cavity that envelops ball 50 to prevent it from falling out. FIG. 2 is a cross-sectional view of exercise device 10 illustrating that housing 40 has an inner ledge 60 around the inner edge of the cavity opening of housing 40. Inner ledge 60 forms a flat surface that continues around the inner cavity opening of housing 40. An inner collar 70 is on the flat surface of inner ledge 60. As shown by a dotted line 80 in FIG. 2, the inner collar 70 is a ring-like structure that rests on inner ledge 60, which defines the opening of the cavity of housing 40. Inner collar 70 is made of a durable material, such as, but not limited to, plastic, rubber, metal, or combinations thereof.

As shown in FIG. 2, exercise device 10 has a ball bearing system or similar type system. The ball bearing system allows ball 50 to have a 360-degree range of motion while exercise device 10 is in use. As shown in FIG. 2, the space between housing 40 and ball 50 forms an area 90. A plurality of ball bearings 100 are within area 90 and are in contact with inner collar 70, housing 40 and ball 50. Ball bearings 100 are held within area 90 by inner collar 70 that is set on inner ledge 60 of housing 40. Inner collar 70 may be slightly concave in shape to guide ball bearings 100 around ball 50. This prevents ball bearings 100 from exiting area 90 at the cavity opening of housing 40. The number of ball bearings 100 in area 90 varies according to the size of ball bearings 100 used and the size of exercise device 10. The ball bearing system provides exercise device 10 with a smooth, fluid 360-degree range of motion.

Handle 30 is attached to housing 40 of exercise device 10 for use. Preferably, exercise device 10 contains a plurality of handles 30 oppositely disposed on housing 40, as shown in FIG. 1. Handle 30 can be made of any durable material, such as, but not limited to, metal or plastic. Handle 30 can have a grip 170 made from additional material, such as rubber or plastic, secured to the end of handle 30 where the user places their hands. Grip 170 provides additional comfort and increased ability to hold handle 30 during use.

Figure 3:
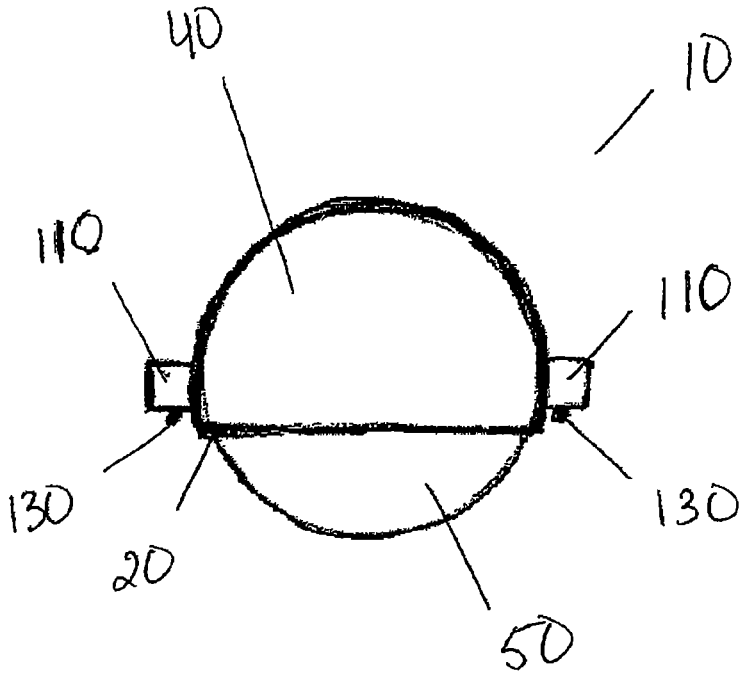
FIG. 3 is a front view of the exercise device of FIG. 1 with handles removed from a base.
Figure 4:
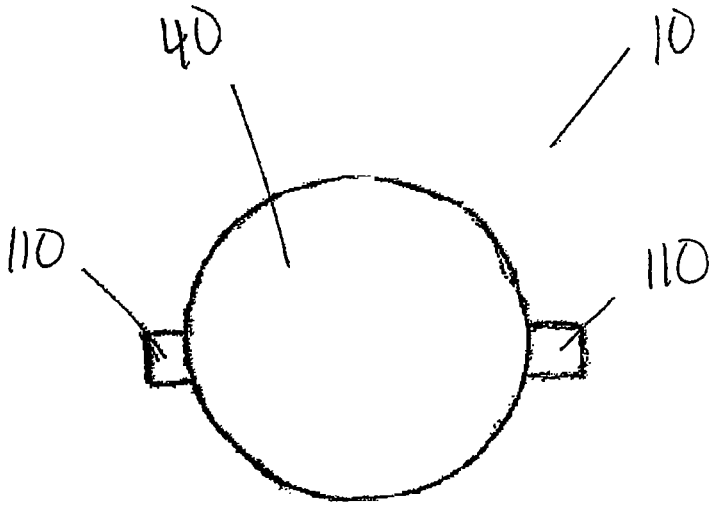
FIG. 4 is a top view of the exercise device of FIG. 3.
Figure 5:
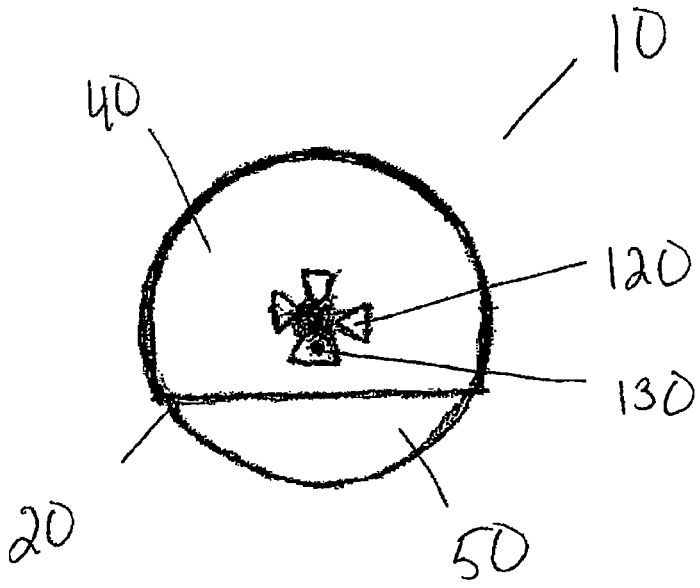
FIG. 5 is a side view of the exercise device of FIG. 3.
Figure 6:
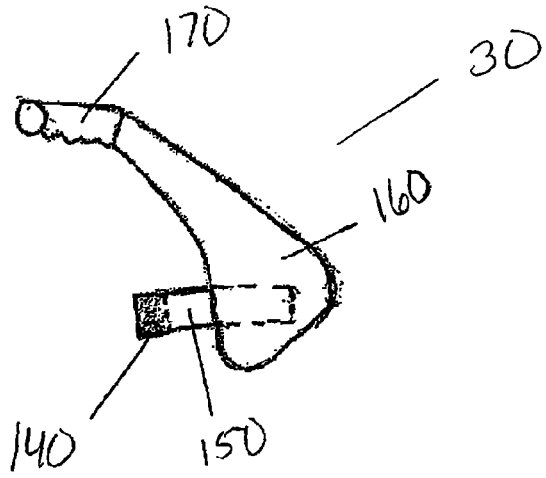
FIG. 6 is a top view of a handle having a forearm rest that is attachable to an exercise device of the present disclosure.
Figure 7:
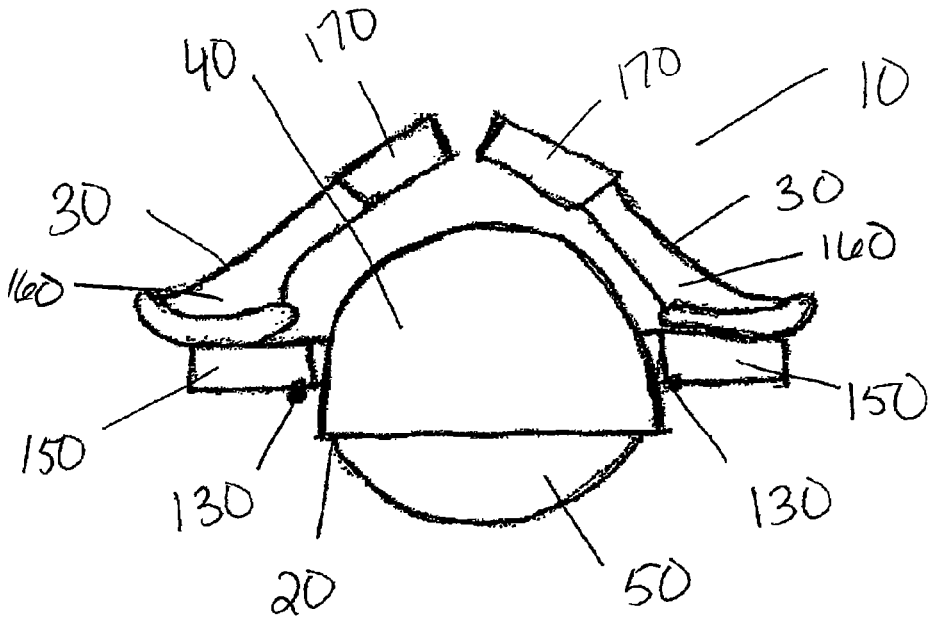
FIG. 7 is a front view of an exercise device having a pair of handles of FIG. 6 attached to the base.

As shown in FIGS. 3, 4 and 5, handle 30 is removable from base 20 and can be replaced with various shapes and styles of handle 30. These shapes and styles include, but are not limited to, handle 30 to grip with the hands (FIGS. 1 and 2) or rest the forearms (FIGS. 6 and 7). During use, changing handles 30 allows the user to alter their body position on exercise device 10 and change the angle of movement to strengthen the user's entire core with a single device. For example, FIG. 6 shows handles 30 each having a forearm rest 160 that allows the use of exercise device 10 while the user leans forward on their forearms. This allows the user to alter positions to target their inner and outer core muscles at varying angles.

As shown in FIG. 3, base 20 of exercise device 10 has at least one protrusion 110 on housing 40. Preferably, a plurality of protrusions 110 are oppositely disposed on housing 40. Additionally, protrusion 110 is typically configured for attaching and detaching handle 30. Preferably, housing 40 will have a protrusion for each handle 30. Protrusion 110 is used for the attachment of multiple styles of handle 30 to base 20. Protrusion 110 is a hollow or solid unit that can be made of any material, such as plastic, metal or other durable material. Protrusion 110 is connected to housing 40 by any conventional means, including, but not limited to, welding or bolting. FIG. 5 shows one embodiment of exercise device 10 having protrusions 110 with flanged ends 120 that can be welded or bolted to housing 40.

Figure 8:
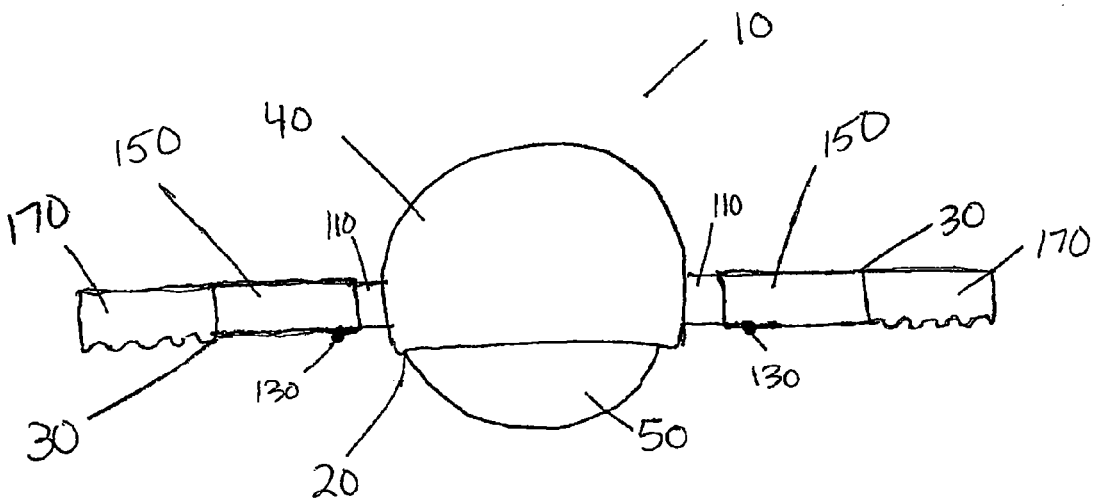
FIG. 8 is a front view of an exercise device of the present disclosure.

Handle 30 can be secured to protrusion 110 by a number of methods. The preferred method includes the use of a button 130 on protrusion 110, as shown in FIG. 3. Button 130 is a spring-loaded button and is preferably located on the bottom side of protrusion 110. Button 130 corresponds with a hole 140 located on a shaft 150 of handle 30, as shown in FIGS. 2 and 6. To attach handle 30, shaft 150 slides over protrusion 110 causing button 130 to retract. Once button 130 and hole 140 are properly aligned, button 130 will release into hole 140, securing handle 30 to exercise device 10, as shown in FIGS. 7 and 8.

To remove and replace handle 30, the user pushes button 130 in and slides shaft 150 off protrusion 110. Protrusion 110 allows handle 30 to be attached to exercise device 10 without going through ball 50. As a result, ball 50 can freely rotate within housing 40 in any direction desired by the user.

Once each handle 30 is properly attached, exercise device 10 is ready to be used. The user kneels down on the floor and places exercise device 10 close to their knees. The user then leans forward holding each handle 30 in their hands, pushing exercise device 10 to roll forward. Once the user's back is straight, they are at an extension point where they will feel tension in their lower abdominals. At this stage, the user will pull exercise device 10 back close to their next desired starting point; for example, to their knees. This produces a push-pull motion of use with exercise device 10. If the user extends exercise device 10 further during the push motion, they will be recruiting the scapular joint movers (trapezius and scapulae, pectoralis minor and rhomboids), as well as the glenhumeral joint movers (anterior deltoids, pectoralis major, biceps tricepslatisimus dorsi teres major and minor, deltoids, subscapularis and infraspinatus) exercising, again, the entire anatomical core.

While performing the push-pull motion, the user also benefits from the incorporation of balance into the use of exercise device 10. The presence of ball bearings 100 in area 90 causes housing 40 to teeter on top of ball 50. As a result, the teetering forces the user to balance his or her body while using exercise device 10. The incorporation of balance recruits the entire anatomical core, through a multi-joint process, providing a great thorough core workout.

Since the user can manipulate exercise device 10 in a 360-degree range of motion, the user is not limited to the push-pull motion described above. The ball bearing system allows exercise device 10 to be moved in any direction, including, but not limited to, side to side, s-shaped formation, v-shaped formation, figure-8 formation and circles. Moving exercise device 10 in multiple directions allows the user to exercise their entire core. The benefits that a user will achieve by exercising the entire core include improved athletic performance due to better efficiency of movement, better muscle control and coordination, increased muscle stabilization, as well as greater core strength, leading to reduced back injuries and loss of work time. Ultimately, the user will feel stronger and have a better physical abdominal appearance.

Once the user has completed exercising, the removal of each handle 30 allows exercise device 10 to be easily transported or stored in a small space. User can easily pack this portable exercise device in luggage to ensure core fitness training even while away from home.

As described above, handle 30 can be designed in various shapes and styles. FIG. 6 shows a style of handle 30 having forearm rest 160 attached to shaft 150. A grip 170 may be secured to the end of forearm rest 160. Handle 30 having forearm rest 160 allows a user to lean their forearms on exercise device 10 during use. The end of forearm rest 160, opposite the end attached to shaft 150, is angled upward and inward to allow the user to easily grab grip 170 or have their hands rest on grip 170 in a natural position. Forearm rest 160 widens in shape as it extends from grip 170 towards shaft 150, and continues past shaft 150 that is attached to the underside of forearm rest 160. Forearm rest 160 is attached to shaft 150 at a slight angle to provide comfort by distributing the user's weight while exercising at that angle. As described above, shaft 150 slides over each protrusion 110 located on oppositely disposed sides of housing 40 to attach handle 30 having forearm rest 160 to exercise device 10.

Forearm rest 160 is contoured and angled on shaft 150 to position the user's forearm comfortably during use. In particular, forearm rest 160 is designed with a slightly curved shape to hold the sides of the user's arms, continuing to contour on all sides and eventually fading out toward the edges. This allows a person with a larger forearm the ability to comfortably extend their forearm past the end of forearm rest 160.

As shown in FIG. 7, once each handle 30 with the forearm rests 160 are properly attached; exercise device 10 can be used. The user bends down on their knees, leans forward and places their forearms on forearm rest 160. The user holds onto grips 170 and pushes exercise device 10 forward. Once the user's back is straight, the user will pull exercise device 10 back towards their knees, still keeping the forearms on forearm rest 160 and hands on grips 170. The user will need to keep exercise device 10 balanced while performing the push-pull motion since the housing 40 will be teetering or hovering on ball 50 via ball bearings 100. Changing handles 30 of exercise device 10 allows the user to target different inner and outer core muscles at varying angles.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the spirit and scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A device comprising:

a housing that is substantially spherical in shape with a hollow portion therein, wherein said housing has a first protrusion and a second protrusion;

a ball that is substantially spherical in shape positioned within said hollow portion such that said housing at least partially encloses the ball therein;

a plurality of bearings are disposed between said housing and said ball, wherein said bearings contact said housing and said ball, thereby allowing said ball to rotate within said housing;

a first handle replaceably connected to said first protrusion by a spring loaded mechanism; and a second handle replaceably connected to said second protrusion by said spring loaded mechanism, wherein said spring loaded mechanism is a spring loaded button disposed on a bottom side of each of said first and second protrusions, respectively.

2. The device of claim 1, wherein said device has a 360 degree range of motion.

3. The device of claim 1, wherein said housing is configured to confine said plurality of bearings such that said plurality of bearings maintain contact with said housing and said ball.

4. The device of claim 1, wherein said first handle and said second handle are configured to support a forearm.

5. The device of claim 1, wherein said first handle and said second handle each have a hand grip.

6. The device of claim 1, wherein said ball is hollow.

7. The device of claim 1, wherein said housing substantially conforms to the shape of said ball.

8. The device of claim 1, wherein said housing has an inner collar, wherein said plurality of bearings are confined by said inner collar to maintain contact with said housing and said ball.

9. A device comprising:

a housing that is substantially spherical in shape with a hollow portion therein, wherein said housing has a first protrusion and a second protrusion;

a ball that is substantially spherical in shape positioned within said hollow portion such that said housing at least partially encloses the ball therein;

a plurality of bearings are disposed between said housing and said ball, wherein said bearings contact said housing and said ball, thereby allowing said ball to rotate within said housing;

a first handle replaceably connected to said first protrusion by a spring loaded mechanism; and a second handle replaceably connected to said second protrusion by said spring loaded mechanism, wherein said spring loaded mechanism is a spring loaded button disposed on a bottom side of each of said first and second protrusions, respectively, wherein said first and second handles each includes a shaft having a hole disposed therein, wherein said shaft slidably fits over the respective first or second protrusion, thereby causing said respective spring loaded button to retract within said first or second protrusion until said button and said hole are aligned, whereby the button will release into said respective hole thereby securing said first or second handle to its respective protrusion.

* * * * *